US007740914B2

(12) United States Patent
Ortega Mahave et al.

(10) Patent No.: US 7,740,914 B2
(45) Date of Patent: Jun. 22, 2010

(54) METHOD TO MANUFACTURE METALLIZED PAPER WITH CURTAIN COATING

(75) Inventors: Luis Amando Ortega Mahave, Leiza-Navarra (ES); José Maria Martínez Corrochano, Leiza-Navarra (ES); Javier Martínez Esparza, Leiza-Navarra (ES)

(73) Assignee: Sarriopapel Y Celulosa, S.A., Leiza (Nevarra) (ES)

( * ) Notice: Subject to any disclaimer, the term of this patent is extended or adjusted under 35 U.S.C. 154(b) by 728 days.

(21) Appl. No.: 10/585,043

(22) PCT Filed: Dec. 30, 2003

(86) PCT No.: PCT/ES03/00669

§ 371 (c)(1),
(2), (4) Date: Apr. 24, 2007

(87) PCT Pub. No.: WO2005/063411

PCT Pub. Date: Jul. 14, 2005

(65) Prior Publication Data

US 2007/0184203 A1 Aug. 9, 2007

(51) Int. Cl.
*B05D 1/36* (2006.01)

(52) U.S. Cl. ..... 427/411; 427/420; 427/393

(58) Field of Classification Search ..... 427/411
See application file for complete search history.

(56) References Cited

U.S. PATENT DOCUMENTS

| | | | | |
|---|---|---|---|---|
| 4,363,851 | A | 12/1982 | Mishina | |
| 4,599,275 | A | 7/1986 | Hayashi | |
| 5,391,401 | A * | 2/1995 | Blake et al. | 427/420 |
| 5,393,571 | A | 2/1995 | Suga et al. | |
| 5,641,544 | A | 6/1997 | Melancon et al. | |
| 7,425,246 | B2 * | 9/2008 | Urscheler | 162/137 |
| 2003/0188839 | A1 | 10/2003 | Urscheler | |
| 2003/0194501 | A1 | 10/2003 | Urscheler et al. | |
| 2003/0235657 | A1 | 12/2003 | Schweizer et al. | |

FOREIGN PATENT DOCUMENTS

| | | | |
|---|---|---|---|
| CA | 2164154 | A * | 6/1996 |
| EP | 715020 | | 6/1996 |
| ES | 8105057 | | 5/1981 |
| GB | 2085757 | | 5/1982 |
| GB | 2085757 | A * | 5/1982 |
| JP | 10008395 | | 1/1998 |
| SU | 1680852 | | 9/1991 |
| WO | WO 02/084029 | A2 | 10/2002 |

* cited by examiner

*Primary Examiner*—Michael Barr
*Assistant Examiner*—Ryan Schiro
(74) *Attorney, Agent, or Firm*—Dann, Dorfman, Herrell and Skillman; Henry H. Skillman; Robert C. Netter, Jr.

(57) ABSTRACT

The method comprises the stages of the curtain coating of a first aqueous film-forming composition on a substrate; and the curtain coating of a second aqueous film-forming composition on said metallized substrate, characterized in that said first and second aqueous film-forming composition comprises a first emulsion polymer and/or a second colloidal dispersion polymer.

9 Claims, No Drawings

METHOD TO MANUFACTURE METALLIZED PAPER WITH CURTAIN COATING

FIELD OF THE INVENTION

The invention refers to a method to manufacture metallized paper which comprises the use of an aqueous coating film-forming composition suitable to be applied by the curtain coating technique.

BACKGROUND OF THE INVENTION

Metallized paper is typically produced by a process of direct high-vacuum metallization. In this process, the substrate that is going to be metallized is initially coated with a layer of film to produce a smooth surface suitable for metallization. The coated paper is introduced in a high vacuum chamber where a vaporized metal, normally aluminium, is applied on its surface. This metal surface is coated with another layer of film to protect said metal layer and prevent it from oxidizing. The layers applied comprise, in general, quantities between 1 and 3 g/m$^2$.

The polymers used for these films or coatings in these applications are of a very varied nature, such as acrylic derivatives, styrenic derivatives, epoxy resins, nitrocellulose, etc. However, all the compositions used in this process have in common the capacity to form a film when the solvent used evaporates.

The layer of coating applied before the metallization should combine a series of requirements such as said surface smoothness, good adhesion of the metal and properties which give a metallic appearance to the paper once metallized. As regards the layer applied after metallization, it should have good surface coating to avoid oxidation of the metal, good adhesion thereto and also a series of requirements that depend on the final application of the finished product.

The application of these compositions on paper is normally performed using gravure techniques. This technique has the main drawbacks of low processing rates and narrow Theological margins which the compositions have to maintain to achieve good application, always within a low viscosity zone.

Following these manufacturing processes, the rates reached do not exceed 400 m/min. Despite constant technological advance, the printing processing rates using gravure are quite far from those produced by other methods typical in paper processes.

With respect to the rheological requirements of the compositions to apply using gravure, it is necessary that they maintain low levels of low-shear viscosity as, otherwise, neither a good transfer of the composition to the paper, nor good levelling, nor a good surface finish thereof, is achieved. This Theological requirement drastically limits the solids content in the composition used, typically not exceeding 30% in the case of compositions in solvent medium and 35% in the case of aqueous medium. In the case of compositions in aqueous medium, this relatively low solids content of the compositions hampers the development of formulations suitable for the process that replace the current compositions in solvent medium.

Another limitation derived from the gravure technique refers to the layer's finish once this has been formed: typically, the layers thus applied all have a series of small surface defects such as small holes, craters and microchannels. These discontinuities in the film thus formed significantly reduce its light, vapour, water and oxygen barrier properties.

In the state of the art, there, therefore, exists the need to provide a method to manufacture metallized paper which overcomes part or all of the limitations of the aforementioned processes of the state of the art.

SUMMARY OF THE INVENTION

The present invention tackles the problem of providing an improved method to manufacture metallized paper which overcomes part or all of the drawbacks of the manufacturing methods of the state of the art.

The solution provided by the present invention is based on the fact that inventors have discovered an aqueous film-forming composition with determined Theological and/or static surface tension properties which makes it suitable for curtain coating in the manufacture of metallized paper.

Therefore, in one aspect, the invention refers to an improved method for manufacturing metallized paper which comprises the curtain coating of an appropriate aqueous film-forming composition on a substrate.

In another aspect, the invention provides an aqueous film-forming composition which comprises a first emulsion polymer and/or a second colloidal dispersion polymer. Said aqueous composition has certain rheological and/or static surface tension characteristics which make it suitable for curtain coating.

The method provided by the present invention, which comprises the curtain coating of said aqueous film-forming composition, has numerous advantages as it enables excellent control of the layer of coating applied and high homogeneity thereof. In this way, high-quality film coatings are achieved, which confer opacity to the coated product, and have good light, water, vapour and oxygen barrier properties. An additional advantage consists of the fact that the method provided by the invention permits reaching production rates of up to 2,000 m/min.

DESCRIPTION OF THE INVENTION

The present invention provides a method to manufacture a metallized paper, hereinafter method of the invention, which comprises the stages of:

(i) curtain coating of a first aqueous film-forming composition on a substrate;

(ii) metallizing the coated substrate; and (iii) curtain coating of a second aqueous film-forming composition on said metallized substrate, characterized in that said first and/or second aqueous film-forming composition comprises a first emulsion polymer and/or a second colloidal dispersion polymer.

Said first and/or second aqueous film-forming composition used in the method to manufacture the metallized paper provided by this invention, hereinafter aqueous film-forming composition of the invention, is characterized in that it has determined rheological and/or static surface tension characteristics, and constitutes an additional aspect of the present invention. More specifically, the aqueous film-forming composition of the invention should have, at least, one of the following technical characteristics:

a) low-shear viscosity, measured in a; Brookfield viscometer at 60 rpm and 20° C., between 60 and 220 mPas, preferably between 100 and 180 mPas;

b) high-shear viscosity, measured in a Haake viscometer at 37,750 s$^{-1}$ and 200° C. between 2 and 35 mPas, preferably between 7 and 20 mPas; or c) static surface tension, measured with a ring tensiometer, between 25 and 40 dyn/cm, preferably between 32 and 37 dyn/cm.

In the sense used in the description, high-shear viscosities are defined as those above 10,000 $s^{-1}$.

In a particular embodiment, the aqueous film-forming composition of the invention has only one of said technical characteristics [a), b) or c)]; however, in a preferred embodiment, the aqueous film-forming composition of the invention has at least two of said technical characteristics [a) and b); or a) and c); or b) and c], more preferably, said aqueous film-forming composition of the invention has the three aforementioned characteristics a), b), and c).

The high and low-shear viscosity values, as well as the static surface tension of said aqueous film-forming composition of the invention, can be included within wide ranges, as previously indicated, which means an improvement with respect to the compositions used in the typical gravure techniques, characterized in that they need to have low levels of low-shear viscosity. The Theological profile values of the aqueous film-forming composition of the invention indicate that they are compositions with strong pseudoplastic characteristics. In a particular embodiment, the high-shear viscosity of the aqueous film-forming composition of the invention is kept low, at a value between 2 and 30 mPas, preferably between 5 and 15 mPas, measured in a Haake viscometer at 37,750 $s^{-1}$ and 20° C., to obtain a good application and maintain an acceptable pressure within the circulation system of said composition by means of the head, e.g. a K-head. On the other hand, a too low low-shear viscosity (the low-shear viscosity is considered low when the viscosity, measured in a Brookfield viscometer at 60 rpm and 20° C., is lower than 60 mPas) prevents the correct levelling of the applied composition from occurring. Advantageously, the low-shear viscosity, measured in a Brookfield viscometer at 60 rpm and 20° C., is equal to or above 60 mPas, more preferably, the low-shear viscosity is between 100 mPas and 180 mPas measured in said conditions. Low-shear viscosities (Brookfield at 60 rpm and 20° C.) equal to or above 60 mPas are sufficient to achieve good stability of the curtain of the aqueous film-forming composition of the invention and maintain its stability, whilst low-shear viscosities (Brookfield at 60 rpm and 20° C.) lower than 60 mPas, lead to irregular application in waves and a poor distribution of the composition on the substrate.

The aqueous film-forming composition of the invention comprises a first emulsion polymer selected from the group formed by an acrylic polymer, an acrylic-styrene polymer, a modified acrylic polymer and their mixtures, and/or a second colloidal dispersion polymer formed by an acrylic polymer, a modified acrylic polymer and their mixtures. In the sense used in this description "modified acrylic polymers" refer to acrylic polymers which include amide and/or amine hydroxyl groups in their structure. In a particular embodiment, said emulsion is an oil in water (O/W) emulsion.

In the sense used in this description, the term "polymer" comprises homopolymers, modified homopolymers, copolymers of two or more different monomers, modified copolymers and their mixtures. In the sense used in this description, the term "modified copolymers" refers to copolymers which include different functional groups in their structure, such as, for example, amines, amides and/or hydroxyls which modify the physicochemical properties of the copolymers.

As a first polymer, a polymer selected from the group formed by an acrylic polymer, an acrylic-styrene polymer, a modified acrylic polymer and their mixtures can be used. Said first polymer is emulsion, e.g. an O/W type emulsion. Illustrative examples of said first polymer include, amongst others, those commercialized with the trademarks Albucryl NHV-21 (Noveno Spain, S.L.), SCX HCR-2000, (Johnson POLYMER), JONCRYL® ECO 2189 (Johnson POLYMER) and JONCRYL® ECO 2189, (Johnson POLYMER), etc.

As a second polymer, a polymer selected from the group formed by an acrylic polymer, a modified acrylic polymer and their mixtures can be used. Illustrative examples of said second polymer include, amongst others, those commercialized with the trademarks PB-383 (Dianal America, Inc.), SCX-JONCRYL 661 (Johnson POLYMER) and 39TSE109 (Johnson POLYMER), etc. Said second polymer is in colloidal dispersion. The size of the colloids can vary within a wide range as it is strongly dependent on the physicochemical parameters of the medium. Nevertheless, the average molecular weight of the polymeric chains used in the aqueous film-forming composition of the invention is between 30,000 and 85,000.

In general, said second colloidal dispersion polymer is prepared conventionally. Depending on the nature of the second polymer and commercial form, said second polymer can be dispersed in water and neutralized with a neutralizing agent such as ammonia, sodium: hydroxide, organic amines, or if it is acquired as a solid, it can be dispersed in water and then neutralized by the use of said neutralizing agent with or without applying heat. In a particular embodiment, the aqueous film-forming composition of the invention comprises a first emulsion polymer in a quantity between 10% and 70% by dry weight with respect to the total dry weight of the resin, and a second colloidal dispersion polymer in a quantity between 30% and 90% by dry weight in relation to the total dry weight of the resin. In the sense used in this description, "resin" refers both to emulsion polymers and colloidal dispersion polymers.

The aqueous film-forming composition of the invention may further contain, if desired, one or more additives selected from thickeners, surfactants, waxes, pigments, conventional products used in the production of metallized paper and their mixtures. Illustrative examples of said conventional products used in the production of metallized paper include anti-foam agents, dispersants, levelling agents, etc.

The thickener modifies the rheology of the composition containing it. Although practically any thickener can be used, in a particular embodiment, said thickener is selected from the group formed by an acrylic, polyurethane, acrylic-acrylamide, cellulosic thickener and their mixtures. Examples of said thickeners include, amongst others, those commercialized with the trademarks, Viscolam 600 (Lamberti), Viscoatex 730 (Coatex) COATEX RHEO® 2000 (Coatex), Coapur® (Campi y Jové, S.A), and Sterocoll® BL (BASF), etc. Although cellulosic thickeners can be used in said composition, i.e. thickeners which comprise a cellulose-based polymer and/or their derivatives, e.g. sodium carboxymethylcellulose, the results provided by the method of the invention when a cellulosic thickener is used alone or combined with another thickener, are substantially worse than those obtained with other thickeners (see Examples 11 and 12 wherein it is shown that gloss typical of mat finish (18%) or non-metallic grey colour are respectively achieved). The gloss of the qualities with gloss finish on metallized paper are typically comprised between 25% and 60%.

In a particular embodiment, the aqueous film-forming composition of the invention comprises, in addition to said first emulsion polymer and said second colloidal dispersion polymer, a thickener in a quantity between 2 and 5% by dry weight of thickener with respect to the total dry weight of resin. In general, the thickener is added to the aqueous film-forming composition of the invention before it is applied on the substrate, e.g. at least 24 hours before the curtain coating of said composition, so that the thickener can perform its effect on the composition rheology before its curtain coating. The thickener is added, in general, slowly and with vigorous mechanical stirring.

The aqueous film-forming composition of the invention may contain, in addition to said first emulsion polymer and said second colloidal dispersion polymer, a surfactant in a quantity between 0.5% and 3% by dry weight of surfactant with respect to the total dry weight of resin, which confers better distribution of the composition during the curtain coating. Said surfactant is selected from the group formed by an anionic surfactant, a nonionic surfactant and their mixtures. Although practically any surfactant can be used, in a particular embodiment, the anionic surfactant is a sulfonic acid derivative, e.g. the surfactant commercialized with the trademark Troysol™ LAC (Troy Chemical Corporation). Likewise, although practically any nonionic surfactant can be used, in a particular embodiment, the nonionic surfactant is a nonionic silicon surfactant, such as a modified polysiloxane, e.g. BYJ-346 or BYK-348 (BYK Chemie).

The aqueous film-forming composition of the invention may contain, in addition to said first emulsion polymer and said second colloidal dispersion polymer, a wax. Although practically any wax can be used, in a particular embodiment said wax is a wax commercialized with trademark LUBAprint 654/D1 (L.P. Bader & Co. GmbH) consisting of a polyethylene wax dispersion in isopropanol. Other waxes that may be used in these compositions comprise mixtures of aqueous dispersion waxes such as those commercialized with trademark Aquacer 535 (BYK Wax Additives); polyethylene derivatives in aqueous dispersion such as those commercialized with trademark 10ZK44 (Sun Chemical); polyethylene dispersed in isopropanol such as that commercialized with trademark Ceracol 40 (BYK Wax Additives), etc. The quantity of wax can vary between 0.5% and 3% by dry weight of wax with respect to the total dry weight of resin, in accordance with the quality and function of the wax.

The aqueous film-forming composition of the invention may contain, if desired, one or more pigments in dispersion or in solution, and/or one or more conventional products used in the production of metallized paper known by those skilled in the art. Amongst these products we can state silicon-derivative levelling additives such as those commercialized with the trademarks BYK-333 and BYK-361 N (BYK Chemie); acrylic levelling additives such as that commercialized with the trademark EDAPALN LA 403 (Münzig Chemie); dispersing agents such as that commercialized with the trademark Disper BYK 191 (BYK Chemie), etc.

The compositions of the invention can be simply prepared in a suitable container or reactor, provided with stirring means, by the consecutive, gradual addition of the different components, as is shown in the different examples which accompany this description. As has been previously mentioned, the method to manufacture metallized paper provided by the invention (method of the invention) comprises the aforementioned embodiment of stages (i), (ii) and (iii), which are described in greater detail hereunder, and is characterized in that it uses an aqueous film-forming composition of the invention in stage (i), or in stage (iii), or in both stages (i) and (iii).

Stage (i) comprises the curtain coating of a first aqueous film-forming composition on a substrate. Said first aqueous film-forming composition can be an aqueous film-forming composition of those typically used in manufacturing metallized papers, preferably, an aqueous film-forming composition of the invention.

The term "substrate" as is used in the present invention refers to a substrate suitable for its metallization, i.e. a substrate which has the physicochemical characteristics which permit the correct application and formation on its surface of a smooth glossy film to be metallized, e.g. a coated paper, such as a paper coated on one of its sides (1/S) or on two side (2/S). Optionally, the substrate can be passed through a hot-air tunnel prior to its first coating with the object of reducing the humidity of said substrate so that stage (ii) of metallization is correctly performed. The temperature of the hot air in this tunnel varies in accordance with the humidity of the substrate and is typically between 100° C. and 140° C.

Curtain coating is a conventional method which comprises, in general, depositing a composition on a substrate by making said substrate pass through the composition which falls in the form of a curtain. The curtain can be generated by passing the composition through an appropriate head. In a particular embodiment, suitable for the embodiment of this invention, said composition is made to pass through a K-head, in particular a single K-head. The height of said head on the substrate band and other parameters of the method relating to the curtain coating can easily be adjusted in each particular case by a person skilled in the art. The composition is discharged in the painter application circuit container. Once the circulation capacity is stabilized and the curtain stability, the formation of foam in the reserve tank and the absence of cuts in the curtain is ensured by visual inspection, the: system is ready to begin application. In a particular embodiment of the method of the invention, the curtain coating width is between 1,300 mm and 2,200 mm, preferably between 1,600 mm and 2,000 mm. In a specific embodiment of this invention, the curtain coating width is approximately 1,600 mm and the distribution of the dry coating film is between 1.5 $g/m^2$ and 3.1 $g/m^2$, preferably between 1.8 $g/m^2$ and 2.5 $g/m^2$.

After stage (i), the first composition applied on the substrate forms a coating or film on said substrate as a result of the evaporation of the water present in said first composition. The water evaporation can be performed using traditional methods, e.g. increasing the temperature of the coated substrate in the circulating hot-air tunnel, e.g. at a temperature above the minimum to form the corresponding film. The circulating hot-air tunnel, can maintain different temperatures in each section thereof, and can easily be determined in each case by someone person skilled in the art to achieve correct water evaporation and achieve the desired final degree of humidity and the final appearance of the coated substrate. Although the degree of absolute humidity of the substrate coated with said first aqueous film-forming composition may vary within a wide range, typically equal to or lower than 3%, in a particular embodiment, the degree of absolute humidity of the substrate coated with said first composition is between 2% and 3%, preferably between 2.3% and 2.8%, with the aim of achieving good metallization in stage (ii). By way of illustration, in a particular embodiment the circulating hot air contained inside the tunnel is maintained at a rising temperature gradient between 80° C. and 140° C.

Stage (ii) regarding the metallization of the coated substrate, can be performed according to conventional methods, e.g. by direct high-vacuum metallization on the substrate obtained in stage (i).

Stage (iii) comprises the curtain coating of a second aqueous film-forming composition on the previously metallized substrate. Said second aqueous film-forming composition, which may be equal to or different from said first aqueous film-forming composition, may be an aqueous film-forming composition of the invention or, alternatively an aqueous film-forming composition of those typically used in the manufacturing of metallic paper; preferably, an aqueous film-forming composition of the invention. One of the characteristics of the method of the invention lies in the fact that at least one of said first or second aqueous film-forming compositions is an aqueous film-forming composition of the invention.

The curtain coating on the previously metallized substrate of said second aqueous film-forming composition is performed in the same way as stage (i). In a particular embodiment, the metallized substrate may have a grammage between 47 g/m$^2$ and 130 g/m$^2$, preferably between 52 g/m$^2$ and 90 g/m$^2$, and the degree of humidity of the metallized structure before being coated with said aqueous film-forming composition is between 1.5% and 2.2%. Once said second aqueous film-forming composition has been applied on the metal substrate, the water is removed so that the film forms on the metal substrate. The water can be removed with any conventional method, e.g. passing the coated metallized substrate through a drying tunnel with circulating hot air to achieve the film formation by water evaporation. Once the water has evaporated and the film has formed, the substrate is re-humidified by applying water to the back of the substrate using conventional systems such as rollers, vapour ramps, etc. The absolute humidity of the metallized paper, once finished, is typically between 3.5% and 5.4%, depending on the quality produced.

The static surface tension of the aqueous film-forming composition of the invention can be controlled using two alternative methods depending on if it is applied on a metallized or non-metallized substrate. In the first case, the angle of contact of a drop of water (TAPPI 458 os-70 method) using a surface wettability meter (Lorentzen & Wettre) method is used, and in the second case, the standardized TAPPI T 698 pm-83 method is used to determine the surface energy of a film using known surface energy solutions. Correct control of said parameters permits attaining correct application of the composition.

The lack of contact in the embodiment of the method of the invention, between the substrate and the composition to be applied, avoids direct contact with the applicators as happens in other techniques of the state of the art, which translates in an excellent control of the coating applied at all times, high homogeneity and high quality of the covered medium. The manufacturing rate increases considerably reaching rates of up to 2,000 m/min, typically between 600 and 1,000 m/min. The method of the invention permits using compositions with wide ranges of rheological profiles and, due to this, with greater solid content. The homogeneity of the: coating is translated in better surface coverage, greater opacity, improving the light, oxygen and water vapour barrier properties. The coated substrate before metallization and the metallized paper and coating obtained at the end of the process, are evaluated to determine the correct distribution of said first and second aqueous film-forming compositions, and measure their gloss with a gloss-meter. In a particular embodiment, the gloss of the coated substrate is measured with a 75° inclination and with a 65° inclination for the metallized paper obtained at the end of the process (see the Examples). In a particular embodiment, the gloss obtained for a coated substrate with an aqueous film-forming composition of the invention when it constitutes said first aqueous film-forming composition, is approximately 70%; the gloss of a metallized substrate before applying a second aqueous film-forming composition in accordance with the method of this invention is typically between 35% and 40%, and the product resulting from the application of the second aqueous film-forming composition of the invention has a gloss between 10% and 25%.

The following illustrative Examples of the invention should not be interpreted as limiting of the scope of protection thereof.

EXAMPLE 1

In a 1,000 liter capacity container, introduce 255.5 kg of water and 33 kg of PB-383 (modified acrylic polymer in solid state, 100% S.C.) To this mixture add, whilst stirring with a wall agitator at 600 rpm, 12 kg of ammonia (25% concentration in water, 0% S.C.) and it is dispersed for 60 minutes with a wall agitator at 600 rpm. After this time, add 33 kg of PB-383, 10 kg of water and keep stirring without changes for a further 60 minutes. After this time, it is left to cool at room temperature, the stirring is slowed to 100 rpm and the following are added consecutively: 12.8 kg of ammonia (25% concentration), 4.0 kg of Lubaprint LD1 (polyethylene wax dispersion in isopropanol, 40% S.C.), 2.10 kg of Troysol LAC (modified sulfosuccinate surfactant, 50% S.C.) and 0.12 kg of KB-70 (water in oil dispersion-type acrylic-acrylamide thickener, 33% S.C.) previously dispersed in 36 kg of water. Finally, add 60 kg of water, maintaining the same stirring for 2 hours. The composition thus prepared is now ready for use and has the following characteristics:

1. viscosity (Brookfield at 60 rpm, 20° C.): 70 mPas;
2. static surface tension, measured with ring tensiometer: 33.1 dyn/cm; and
3. solids content of the composition: 14.4%.

Method of Application

The composition is discharged in the painter application circuit container. Once the circulation capacity is stabilized and the curtain stability, foam formation in the reserve tank and the absence of cuts in the curtain are ensured by visual inspection, the system is ready to begin application. This procedure is the same in all the Examples below.

It is applied on a 1/S coated medium suitable for metallization, of weight equal to 60 g/m$^2$. The support's grammage is between 47 and 130 g/m$^2$. The application width in this case is 140 cm. The application rate is between 800 and 1,000 m/min. The distribution of the dry film applied is between 1.6 and 2.5 g/m$^2$. The paper is passed through a hot-air drying tunnel and exits thereof at a temperature of 105-110° C. before the composition is applied thereto. After applying the composition, the paper is passed through another hot-air tunnel wherein a temperature gradient is maintained, rising from 80° C. in the first section to 140° C. in the last section. Once the paper is dry, it is rolled on an iron mandrel in the machine's rewind unit. The absolute humidity of the paper is between 2.0 and 2.5%. The paper thus prepared is ready for the high-vacuum metallization process.

EXAMPLE 2

In a 1,000 liter capacity container, introduce 400 kg of water and 200 kg of SCX-661 (colloidal acrylic polymer solution, 44% S.C.) To this mixture add, whilst stirring (wall agitator at 600 rpm), 25 kg of ammonia (25% concentration in water, 0% S.C.) and it is dispersed for 20 minutes in the same stirring conditions. After this time, add the following consecutively: 5.37 kg of Lubaprint LD1 (polyethylene wax dispersion in isopropanol, 40% S.C.), 2.69 kg of Troysol LAC (modified sulfosuccinate surfactant, 50% S.C.) and 0.19 kg of KB-70 (water in oil dispersion-type acrylic-acrylamide thickener, 33% S.C.) previously dispersed in 57 kg of water. Finally, add 100 kg of water, maintaining the same stirring for 2 hours. The composition thus prepared is now ready for use and has the following characteristics:

1. viscosity (Brookfield at 60 rpm, 20° C.) between 107-116 mPas;
2. static surface tension, measured with ring tensiometer: 32.2 dyn/cm; and
3. solids content of the composition: 11.5%.

Method of Application

It is applied on a 60 g/m$^2$ 1/S coated medium suitable for metallization. The support's grammage is between 47 and 130 g/m$^2$. The application width in this case is 140 cm. The application rate varies between 600 and 1,000 m/min. The distribution of the dry film applied is between 1.5 and 2.5 g/m$^2$. The paper is passed through a hot-air drying tunnel and exits thereof at a temperature of 105-110° C. before the composition is applied thereto. After applying the composition, the paper is passed through another hot-air tunnel wherein a temperature gradient is maintained, rising from 80° C. in the first section to 140° C. in the last. Once the paper is dry, it is rolled on an iron mandrel in the machine's rewind unit. The absolute humidity of the paper is between 2.0 and 2.5%. The paper thus prepared is ready for the high-vacuum metallization process.

EXAMPLE 3

In a 1,000 liter capacity container, introduce, whilst stirring (600 rpm), 280 kg of water, 120 kg of SCX-661 (colloidal acrylic polymer solution, 44% S.C.), 13.3 kg of Albucryl NHV-21 (aqueous acrylic-styrene polymer emulsion) and 24 kg of a sodium hydroxide solution in water (20% solids concentration). It is stirred for 20 minutes, after which the stirring speed is reduced to 100 rpm and the following are added consecutively: 3.60 kg of Lubaprint LD1 (polyethylene wax dispersion in isopropanol, 40% S.C.) and 1.80 kg of Troysol LAC (modified sulfosuccinate surfactant, 50% S.C.). Finally, 100 kg of water, are added maintaining the same stirring for 2 hours. The composition thus prepared is now ready for use and has the following characteristics:

1. viscosity (Brookfield at 60 rpm, 20° C.): 61 mPas;
2. high-shear viscosity (Haake at 37,750 s$^{-1}$, 20° C.) 29.8 mPas;
3. static surface tension, measured with ring tensiometer: 32.0 dyn/cm; and
4. solids content of the composition: 12.7%.

Method of Application

It is applied on a 60 g/m$^2$ 1/S coated medium suitable for metallization. The support's grammage is between 47 and 130 g/m$^2$. The application width in this case is 140 cm. The application rate is between 600 and 800 m/min. The composition discharge through the head is maintained at 26.5 l/min. The distribution of the dry film applied is between 1.85 and 2.5 g/m$^2$.

The paper is passed through a hot-air drying tunnel at 140° C. before being coated. After applying the composition, the paper is passed through another hot-air tunnel wherein a rising temperature gradient between 85 and 140° C. is maintained. Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization and 600 in. the case of the already metallized product. The metallized paper's gloss before application of the second aqueous film-forming composition is 40%.

EXAMPLE 4

In a 1,000 liter capacity container, introduce, whilst stirring (600 rpm), 190 kg of water and 103 kg of HCR-2000 (acrylic polymer emulsion, 40% S.C.). Still stirring, add, little by little, 2.1 kg of Viscoatex 730 (non-associative thickener based on an aqueous acrylic copolymer emulsion, 30% S.C.) previously diluted in 15.4 kg of water. The stirring is then reduced to 100 rpm and the following are added consecutively: 2.5 kg of Lubaprint LD1 (polyethylene wax dispersion in isopropanol, 40% S.C.), 1.2 kg of Troysol LAC (modified sulfosuccinate surfactant, 50% S.C.) and 0.046 kg of KB-70 (water in oil dispersion-type acrylic-acrylamide thickener, 33% S.C.) previously dispersed in 13.8 kg of water. To this mixture, add 49 kg of SCX-661 and 12.6 kg of a 20% sodium hydroxide solution in water. It is stirred for 2 hours and then the composition is left at rest for 24 hours. After this time, the composition thus prepared is now ready for use and has the following characteristics:

1. viscosity (Brookfield at 60 rpm, 20° C.): 60 mPas;
2. high-shear viscosity (Haake at 37,750 s$^{-1}$, 20° C.): 11.6 mPas;
3. static surface tension, measured with ring tensiometer: 32 dyn/cm; and
4. solids content of the composition: 16.0%.

Method of Application

It is applied on a 60 g/m$^2$ 1/S coated medium suitable for metallization. The support's grammage is between 47 and 130 g/m$^2$. The application width in this case is 140 cm. The application rate is between 600 and 1030 m/min. The composition discharge through the head is maintained at 26.5 1/min. The distribution of the dry film applied is between 1.8 and 3.1 g/m$^2$. The paper is passed through a hot-air drying tunnel at 140° C. before being coated. After applying the composition, the paper is passed through another hot-air tunnel wherein a rising temperature gradient between 85 and 140° C. is maintained. Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization (giving a result of 70%) and 600 in the case of the already metallized product. The metallized paper's gloss before application of the second aqueous film-forming composition is 37%.

EXAMPLE 5

In a 1,000 liter capacity container,: introduce, whilst stirring (600 rpm), 300 kg of water and 141 kg of HCR-2000 (acrylic polymer emulsion, 40% S.C.). Still stirring, add, little by little, 2.8 kg of Viscoatex 730 (non-associative thickener based on an aqueous acrylic copolymer emulsion, 30% S.C.) previously diluted in 10 kg of water. The stirring is then reduced to 100 rpm and the following are added consecutively: 3.5 kg of Lubaprint LD1 (polyethylene wax dispersion in isopropanol, 40% S.C.), 1.7 kg of Troysol LAC (modified sul-fosuccinate surfactant, 50% S.C.) and 0.063 kg of KB-70 (water in oil dispersion-type acrylic-acrylamide thickener, 33% S.C.) previously dispersed in 18.9 kg of water. It is stirred for 2 hours and then the paint is left at rest for 24 hours. After this time, the composition thus prepared is now ready for use and has the following characteristics:

1. viscosity (Brookfield at 60 rpm, 20° C.): 70 mPas;
2. high-shear viscosity (Haake at 37,750 s$^{-1}$): 2.3 mPas;

3. static surface tension, measured with ring tensiometer: 32 dyn/cm; and
4. solids content of the composition: 11.8%.

Method of Application

It is applied on a 60 g/m$^2$ 1/S coated medium suitable for metallization. The support's grammage is between 47 and 130 g/m$^2$. The application width in this case is 140 cm. The application rate varies between 600 and 700 m/min. The composition discharge through the head is maintained at 26.5 l/min. The distribution of the dry film applied is between 1.95 and 2.3 g/m$^2$. The paper is passed through a hot-air drying tunnel at 140° C. before the composition is applied thereto. After applying the composition, the paper is passed through another hot-air tunnel wherein a rising temperature gradient between 80 and 140° C. is maintained. Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization (giving a 58% result) and 600 in the case of the already metallized product. The metallized paper's gloss before application of the second aqueous film-forming composition is 35%.

EXAMPLE 6

In a 1,000 liter capacity container, introduce, whilst stirring (600 rpm), 217 kg of water and 143 kg of Albucryl NHV-21 (acrylic-styrene polymer emulsion, 42% S.C.). Still stirring, add, little by little, 7.1 kg of Viscoatex 730 (non-associative thickener based on an aqueous acrylic copolymer emulsion, 30% S.C.) previously diluted in 33.5 kg of water. The stirring is then reduced to 100 rpm and the following are added consecutively: 3.6 kg of Lubaprint LD1 (polyethylene wax dispersion in isopropanol, 40% S.C.) and 1.9 kg of Troysol LAC (modified sulfosuccinate surfactant, 50% S.C.). It is stirred for 2 hours and then the composition is left at rest for 24 hours. After this time, the composition thus prepared is now ready for use and has the following characteristics:

1. viscosity (Brookfield at 60 rpm, 20° C.): 104 mPas;
2. high-shear viscosity (Haake at 37,750 s$^{-1}$): 4.6 mPas;
3. static surface tension, measured with ring tensiometer: 32.3 dyn/cm; and
4. solids content of the composition: 16.1%.

Method of Application

It is applied on a 60 g/m$^2$ 1/S coated medium suitable for metallization. The support's grammage is between 47 and 130 g/m$^2$. The application width in this case is 140 cm. The application rate is between 600 and 700 m/min. The composition discharge through the head varies between 18.0 and 31.0 l/min. The distribution of the dry film applied is between 1.60 and 2.2 g/m$^2$. The paper is passed through a hot-air drying tunnel at 140° C. before the curtain coating. After applying the composition, the paper is passed through another hot-air tunnel wherein a rising temperature gradient between 75 and 140° C. is maintained . Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization (giving a result of 76%) and 60° in the case of the already metallized product. The metallized paper's gloss before application of the second aqueous film-forming composition is 40%.

EXAMPLE 7

In a 1,000 liter capacity container, introduce 400 kg of 39TSE109 (colloidal modified acrylic polymer solution, 13% S.C.). Stirring at 100 rpm, add 3.25 kg of Lubaprint LD1 (polyethylene wax dispersion in isopropanol, 40% S.C.) and 1.7 kg of Troysol LAC (modified sulfosuccinate surfactant, 50% S.C.) mixed manually in a 15 liter capacity container together with 11.5 kg of water. It is stirred for 2 hours. The composition thus prepared is now ready for use and has the following characteristics:

1. viscosity (Brookfield at 60 rpm, 20° C.): 105 mPas;
2. high-shear viscosity (Haake at 37,750 s$^{-1}$, 20° C.) 22.8 mPas;
3. static surface tension, measured with ring tensiometer: 33.0 dyn/cm; and
4. solids content of the composition: 13%.

Method of Application

It is applied on a 60 g/m$^2$ 1/S coated medium suitable for metallization. The support's grammage is between 47 and 130 g/m$^2$. The application width in this case is 140 cm. The application rate varies between 700 and 800 m/min. The composition discharge through the head was 26.5 l/min. The distribution of the dry film applied is between 1.9 and 2.1 g/m$^2$. The paper is passed through a hot-air drying tunnel at 140° C. before the composition is applied thereto. After applying the composition, the paper is passed through another hot-air tunnel wherein a rising temperature gradient between 75 and 145° C. is maintained. Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization (giving a result of 71%) and 60° in the case of the already metallized product. The metallized paper's gloss before application of the second aqueous film-forming composition is 37%.

EXAMPLE 8

In a 1,000 liter capacity container, introduce, whilst stirring (600 rpm), 138 kg of water, 62 kg of Albucryl NHV-21 (acrylic-styrene polymer emulsion, 42% S.C.) and 200 kg of 39TSE109 (colloidal modified acrylic polymer solution, 13% S.C.). Still stirring, add, little by little, 4.9 kg of Viscoatex 730 (non-associative thickener based on an aqueous acrylic copolymer emulsion, 30% S.C.) previously diluted in 15 kg of water. The stirring is then reduced to 100 rpm and the following are added consecutively: 3.25 kg of Lubaprint LD1 (polyethylene wax dispersion in isopropanol, 40% S.C.) and 1.7 kg of Troysol LAC (modified sulfosuccinate surfactant, 50% S.C.) mixed manually in a 25 liter capacity metal container together with 11.5 kg of water. It is stirred for 2 hours and then the composition is left at rest for 24 hours. After this time, the composition thus prepared is now ready for use and has the following characteristics:

1. viscosity (Brookfield at 60 rpm, 20° C.): 70 mPas;
2. high-shear viscosity (Haake at 37,750 s$^{-1}$, 20° C.): 9.2 mPas;
3. static surface tension, measured with ring tensiometer: 33.4 dyn/cm; and
4. solids content of the composition: 12.5%.

Method of Application

It is applied on a 60 g/m$^2$ 1/S coated medium suitable for metallization. In any case, the support's grammage is variable, and can be between 47 and 130 g/m$^2$. The application width in this case is 140 cm. The application rate is between 700 and 800 m/min. The composition discharge through the head is 26.5 l/min. The distribution of the dry film applied is between 1.9 and 2.1 g/m$^2$. The paper is passed through a hot-air drying tunnel at 140° C. before applying the composition thereto. After applying the composition, the paper. is passed through another hot-air tunnel wherein a rising temperature gradient between 75 and 145° C. is maintained. Once the paper is dry, it is rolled on an iron mandrel in the machine's rewind unit. The absolute humidity of the paper is 2.9%. Product control is performed, evaluating the distribution of the composition on the paper, measuring its gloss with a gloss-meter and at a 75° inclination for the case of the product before metallization (giving a result of 73%) and 60° in the case of the already metallized product. The metallized paper's gloss before application of the second aqueous film-forming composition is 41%.

EXAMPLE 9

In a 1,000 liter capacity container, introduce, whilst stirring (600 rpm), 170 kg of water, 44.5 kg of EC02189 (acrylic-styrene polymer emulsion, 48%. S.C.), 19.9 kg of ECO2177 (acrylic polymer emulsion, 46% S.C.) and 254 kg of 39 kg of 39TSE109 (colloidal modified acrylic polymer solution, 13% S.C.). Still stirring, add, little by little, 6.1 kg of Viscoatex 730 (non-associative thickener based on an aqueous acrylic copolymer emulsion, 30% S.C.) previously diluted in 25 kg of water. The stirring is then reduced to 100 rpm and the following are added consecutively: 3.8 kg of Lubaprint LD1 (polyethylene wax dispersion in isopropanol, 40% S.C.) and 1.8 kg of Troysol LAC (modified sulfosuccinate surfactant, 50% S.C.) mixed manually in a 25 liter capacity metal container together with 15 kg of water. It is stirred for 2 hours and then the composition is left at rest for 24 hours. After this time, the composition thus prepared is now ready for use and has the following characteristics:

1. viscosity (Brookfield at 60 rpm, 20° C.): 152 mPas;
2. high-shear viscosity (Haake at 37,750 s$^{-1}$, 20° C.) 10.2 mPas;
3. static surface tension, measured with ring tensiometer: 33.0 dyn/cm; and
4. solids content of the composition: 12.6%.

Method of Application

It is applied on a 60 g/m$^2$ 1/S coated medium suitable for metallization. The support's grammage is between 47 and 130 g/m$^2$. The application width is 140 cm. The application rate varies between 700 and 750 m/min. The composition discharge through the head varies between 23.5 and 26.5 l/min. The distribution of the dry film applied is between 1.85 and 1.95 g/m$^2$. The paper is passed through a hot-air drying tunnel at 140° C. before being coated. After applying the composition, the paper is passed through another hot-air tunnel wherein a rising temperature gradient between 75 and 140° C. is maintained. Once the paper is dry, it is rolled on an iron mandrel in the machine's rewind unit. The absolute humidity of the paper is 2.9%. Product control is performed, evaluating the distribution of the composition on the paper, measuring its gloss with a gloss-meter and at a 75° inclination for the case of the product before metallization (giving a result of 72%) and 60° in the case of the already metallized product. The metallized paper's gloss before application of the second aqueous film-forming composition is 40-41%.

EXAMPLE 10

In a 1,000 liter capacity container, introduce 280 kg of water and 163.5 kg of Albucryl NHV-21 (aqueous acrylic-styrene polymer emulsion, 42% S.C.). To this mixture add, whilst stirring mechanically (100 rpm), 4.19 kg of Lubaprint LD1 (polyethylene wax dispersion in isopropanol, 40% S.C.). To this mixture, subjected to vigorous stirring (600 rpm), add, little by little, 7.82 kg of Viscoatex 730 (non-associative thickener based on an aqueous emulsion of acrylic copolymers, 30% S.C.) previously diluted in 15 kg of water. Following the same method of addition, add 5.58 kg of RHEO-2000 (non-associative thickener based on an aqueous acrylic copolymer emulsion, S.C. 30%) previously diluted in 15 kg of water. Still stirring, add 8.07 kg of COAPUR 3025 (polyurethane-type associative thickener, 25% S.C.) previously diluted with vigorous stirring (600 rpm) in 36 kg of water. Finally, add 4.02 kg of Troysal LAC surfactant (modified sulfosuccinate, 50% S.C.) and 0.146 kg of KB-70 (water in oil dispersion-type acrylic-acrylamide thickener, 33% S.C.) previously dispersed in 44 kg of water. It is stirred for 30 minutes and it is then left with gentle stirring (100 rpm) for 2 hours to reduce the foam formed. Once this time has passed, the composition is left at rest for 24 hours. After this time, the composition thus prepared is now ready for use and has the following characteristics:

1. viscosity (Brookfield at 60 rpm, 20° C.): 156-212 mPas;
2. high-shear viscosity (Haake at 37,750 s$^{-1}$, 20° C.): 10 mPas;
5. static surface tension, measured with ring tensiometer: 34.0 dyn/cm; and
6. solids content of the composition: 14.1%.

Method of Application

It is applied on a 60 g/m$^2$ 1/S coated medium suitable for metallization. The support's. grammage is between 47 and 130 g/m$^2$. The application width in this case is 140 cm. The application rate is between 700 and 1000 m/min. The composition discharge through the head varies between 15.6 and 26.0 l/min. The distribution of the dry film applied is between 1.5 and 2.5 g/m$^2$. The paper is passed through a hot-air drying tunnel at 140° C. before the composition is applied thereto. After applying the composition, the paper is passed through another hot-air tunnel wherein a rising temperature gradient, between 80° C. in the first section and 140° C. in the last section, is maintained. Once the paper is dry, it is rolled on an iron mandrel in the machine's rewind unit. The product thus prepared is ready for the high-vacuum metallization process. The paper's gloss when metallized was 40% at 600.

EXAMPLE 11

Composition for Post-Metallization

In a 100 liter capacity container, introduce 179.8 kg of Albucryl NHV-21 (aqueous acrylic-styrene polymer emulsion, 42% S.C.), 4.7 kg of Lubaprint LD1 (polyethylene wax dispersion in isopropanol, 40% S.C.) and 4.2 kg of Troysal LAC (modified sulfosuccinate surfactant, 50% S.C.). Add, whilst stirring the mixture (wall stirring at 600 rpm), 1.43 kg of Cellogen EP (DAI-ICHI KOKYO SEIYAKU CO. LTD.) (carboxymethylcellulose with average molecular weight of 50,000, solid product) previously dissolved in 141.5 kg of water (1% concentration) and 0.33 kg of KB-70 (water in oil dispersion-type acrylic-acrylamide thickener, 33% S.C.) previously dispersed in 100 kg of water The mixture is stirred (wall stirring at 300 rpm) for 30 minutes and finally, 20 kg of water are added. The composition thus prepared is now ready for use and has the following characteristics:

1. viscosity (Brookfield at 60 rpm, 20° C.): 10 mPas;
2. static surface tension, measured with ring tensiometer: 35 dyn/cm; and
3. solids content of the composition: 15.4%.

Method of Application

It is applied on a metallized paper with a grammage of 62.5 g/m$^2$ (although the application can be generalized to grammages between 47 and 130 g/m$^2$) which has been previously coated with the aqueous film-forming composition of Example 11. After the application of the composition, the paper is passed through a hot-air drying tunnel wherein a temperature of 130° C. is maintained. Once dry, the paper is re-humidified by applying water to the back using a standard LAS-type system and it is subsequently rolled on an iron mandrel in the machine's rewind unit. The product thus prepared is ready for the handling process. The humidity of the paper rolled thereon should be 4.5%. The paper thus prepared is ready for the manipulation process. Product control is performed, evaluating the distribution of the composition on the paper, measuring its gloss with a gloss-meter and an inclination of 60° C. In the case of this test, the gloss is practically null (18%).

This example shows that the method of the invention which comprises the use of a composition comprising a cellulosic thickener achieves metal papers with practically-no gloss.

EXAMPLE 12

Comparative Example with Cellulosic Thickeners.

In a 100 liter capacity container, introduce 328.8 kg of Albucryl NHV-21 (aqueous acrylic-styrene polymer emulsion, 42% S.C.), 111 kg of water, 8.6 kg of Lubaprint LD1 (polyethylene wax dispersion in isopropanol, 40% S.C.) and 4.1 kg of Troysal LAC (modified sulfosuccinate surfactant, 50% S.C.). Add, whilst stirring the mixture (wall stirring at 600 rpm), 2.58 kg of Cellogen EP (DAI-ICHI KOKYO SEIYAKU CO. LTD.) (carboxymethylcellulose with average molecular weight of 50,000, solid product) previously dissolved in 256 kg of water with a 1% concentration. The mixture is for 30 minutes and, finally, 20 kg of water are added. The composition thus prepared is now ready for use and has the following characteristics:

1. viscosity (Brookfield at 60 rpm, 20° C.): 78 mPas;
2. static surface tension, measured with ring tensiometer: 33.5 dyn/cm; and
3. solids content of the composition: 16%.

Method of Application

It is applied on a 60 g/m$^2$ 1/S coated medium suitable for metallization. The support's grammage is between 47 and 130 g/m$^2$. The application width in this case is 140 cm. The application rate is 700 m/min. The composition discharge through the head is 26.5 l/min. The distribution of the dry film applied is 2.2 g/m$^2$. The paper is passed through a hot-air drying tunnel at 130° C. before the composition is applied thereto. After applying the composition, the paper is passed through another hot-air tunnel wherein a rising temperature gradient, between 80° C. in the first section and. 140° C. in the last section, is maintained. Once the paper is dry, it is rolled on an iron mandrel in the machine's rewind unit. The absolute humidity of the paper should not be above 3.0% so as to obtain a correct metallization with the manufacturing process. The gloss of the paper coated with this first composition is practically null (around 20% at 75°) and the appearance after the process is non-metallic grey.

EXAMPLE 13

Comparative Example with High Surface Tension

In a 1,000 liter capacity container, introduce 275 kg of water and 150 kg of Albucryl NHV-21 (aqueous acrylic-styrene polymer emulsion, 42% S.C.). To this mixture add, whilst stirring mechanically (100 rpm), 3.75 kg of Lubaprint LD1 (polyethylene wax dispersion in isopropanol, 40% S.C.). To this mixture, subjected to vigorous stirring (600 rpm), add, little by little, 7.00 kg of Viscoatex 730 (non-associative thickener based on an aqueous emulsion of acrylic copolymers, 30% S.C.) previously diluted in 15 kg of water. Following the same method of addition, add 5.00 kg of RHEO-2000 (non-associative thickener based on an aqueous acrylic copolymer emulsion, S.C. 30%) previously diluted in 15 kg of water. Whilst stirring, add 7.20 kg of COAPUR 3025 (polyurethane-type associative thickener, 25% S.C.) previously diluted with vigorous stirring (600 rpm) in 33 kg of water. Finally, add 1.30 kg of Troysal LAC surfactant (modified sulfosuccinate, 50% S.C.). It is stirred for 30 minutes and it is then left with gentle stirring (100 rpm) for 2 hours to reduce the foam formed. Once this time has passed, the composition is left at rest for 24 hours. After this time, the composition thus prepared is now ready for use and has the following characteristics:

1. viscosity (Brookfield at 60 rpm, 20° C.): 200 mPas;
2. high-shear viscosity (Haake at 37,750 s$^{-1}$, 20° C.): 8.7 mPas;
3. static surface tension, measured with ring tensiometer: 42 dyn/cm; and
4. solids content of the composition: 13.5%.

Method of Application

It is applied on a 60 g/m$^2$ 1/S coated medium suitable for metallization. The support's grammage is between 47 and 130 g/m$^2$. The application width in this case is 140 cm. The application rate varies between 700 and 1000 m/min. The composition discharge through the head is 27.6 l/min. The distribution of the dry film applied is between 1.5 and 2.5 g/m$^2$. The paper is passed through a hot-air drying tunnel before the composition is applied thereto, exiting thereof at a temperature of 105-110° C. After applying the composition, the paper is passed through another hot-air tunnel wherein a rising temperature gradient, between 80° C. in the first section and 140° C. in the last section, is maintained. Once the paper is dry, it is rolled on an iron mandrel in the machine's rewind unit. The product thus prepared is ready for the high-vacuum metallization process. The paper's gloss when metallized before applying the second layer was 33-34% at 60°.

The results show that the application was irregular, with areas of very low layer thickness which appear as areas with very defective appearance once metallized. This bad application may be associated with a poor distribution of the composition due the surface energy of the composition used being excessively high.

EXAMPLE 14

Comparative Example with Low Low-Shear Viscosity

In a 1,000 liter capacity container, introduce, whilst stirring (600 rpm), 250 kg of water, 56 kg of SCX-661 (colloidal acrylic polymer solution, 44% S.C.), 144 kg of Albucryl NHV-21 (aqueous acrylic-styrene polymer emulsion) and 10.4 kg of a sodium hydroxide solution in water (20% solids content). It is stirred at this rate for 20 minutes, after which the stirring rate is reduced to 100 rpm and the following are added consecutively: 5.40 kg of Lubaprint LD1 (polyethylene wax dispersion in isopropanol, 40% S.C.), 2.70 kg of Troysol LAC (modified sulfosuccinate surfactant, 50% S.C.) and 0.18 kg of KB-70 (water in oil dispersion-type acrylic-acrylamide thickener, 33% S.C.) previously dispersed in 30 kg of water. Finally, the same stirring is maintained for 2 hours. After this time, the composition thus prepared is now ready for use and has the following characteristics:

1. viscosity (Brookfield at 60 rpm, 20° C.): 20 mPas;
2. high-shear viscosity (Haake at 37,750 $s^{-1}$, 20° C.): 9.2 mPas
3. static surface tension, measured with ring tensiometer: 33.0 dyn/cm; and
4. solids content of the composition: 16.0%

Method of Application

It is applied on a 60 g/$m^2$ 1/S coated medium suitable for metallization. The support's grammage is between 47 and 130 g/$m^2$. The application width in this case is 140 cm. The application rate varies between 620 and 1000 m/min. The composition discharge through the head is maintained between 27 and 31 l/min. The distribution of the dry film applied is between 2.0 and 3.7 $m^2$.

The paper is passed through a hot-air drying tunnel at 140° C. before being coated. After applying the composition, the paper is passed through another hot-air tunnel wherein a rising temperature gradient between 85° C. and 140° C. is maintained. Once the paper is dry, it is rolled on an iron mandrel in the machine's rewind unit. The absolute humidity of the paper is 2.8%. Product control is performed, evaluating the distribution of the composition on the paper, measuring its gloss with a gloss-meter and at a 75° inclination for the case of the product before metallization and 60° in the case of the already metallized product. The metallized paper's gloss before application of the second aqueous film-forming composition is 32-33%.

The results obtained show that the application was irregular. The stability of the curtain is poor, a distribution of the composition once dry on the paper being observed to have waves, characteristic of this defective stability of the curtain.

EXAMPLE 15

Comparative Example with High High-Shear Viscosity

In a 1,000 liter capacity container, introduce, 250 kg of water and 33 kg of PB-383 (modified acrylic polymer in solid state, 100% C.S.). To this mixture add, whilst stirring (wall agitator at 600 rpm), 35.3 kg of a sodium hydroxide solution in water (20% solids concentration) and it is dispersed for 60 minutes (wall agitator at 600 rpm). After this time, add 33 kg of PB-383, 10 kg of water and keep stirring, with no change, for another 60 minutes. After this time add the following consecutively: 37.6 kg of ammonia (25% concentration), 4.0 kg of Lubaprint LD1 (polyethylene wax dispersion in isopropanol, 40% S.C.), 2.10 kg of Troysol LAC (modified sulfosuccinate surfactant, 50% S.C.) and 0.12 kg of KB-70 (water in oil dispersion-type acrylic-acrylamide thickener, 33% S.C.) previously dispersed in 12 kg of water. Finally, the same stirring is maintained for 2 hours. After this time, the composition thus prepared is now ready for use and has the following characteristics:

1. viscosity (Brookfield at 60 rpm, 20° C.): 70 mPas;
2. static surface tension, measured with ring tensiometer: 33.1 dyn/cm;
3. high-shear viscosity (Haake at 37,750 $s^{-1}$, 20° C.) 39 mPas; and
4. solids content of the composition: 16.2%

Method of Application

It is applied on a 1/S coated medium suitable for metallization, of weight equal to 60 g/$m^2$. The support's grammage is between 47 and 130 g/$m^2$. The application width in this case is 140 cm. The application rate is between 800 and 1,000 m/min. The distribution of the dry film applied is between 1.8 and 2.8 $m^2$. The paper is passed through a hot-air drying tunnel exiting thereof at a temperature of 105-110° C. before the composition is applied thereto. After applying the composition, the paper is passed through another hot-air tunnel wherein a rising temperature gradient, between 80° C. in the first section and 140° C. in the last section, is maintained. Once the paper is dry, it is rolled on an iron mandrel in the machine's rewind unit. The absolute humidity of the paper is between 2.0 and 2.5%. The paper thus prepared is ready for the high-vacuum metallization process.

In this case we observe an incorrect paint flow in the curtain and the formation of a "heel" at the application point. After metallization, areas are observed with barely any film.

The invention claimed is:

1. Method to manufacture a metallized paper which comprises the stages of:

(i) curtain coating of a first aqueous film-forming composition on a substrate;

(ii) metallizing the coated substrate; and (iii) curtain coating of a second aqueous film-forming composition on said metallized substrate, characterized in that said first and second aqueous film-forming composition comprises a first emulsion polymer and/or second colloidal dispersion polymer, wherein said first and/or second aqueous film-forming composition is selected from an acrylic polymer, an acrylic-styrene polymer, a modified acrylic polymer and their mixtures and wherein said first and/or second aqueous film-forming composition has:

a) a low-shear viscosity, measured in a Brookfield viscometer at 60 rpm and 20° C., between 60 and 220 mPas;

b) a high-shear viscosity, measured in a Haake viscometer at 37,750 $s^{-1}$and 20° C., between 2.3 and 35 mPas; and c) a static surface tension, measured by a ring tensiometer, between 25 and 40 dyn/cm.

2. Method according to claim 1, wherein said first and/or second aqueous film-forming composition has a low-shear viscosity, measured in a Brookfield viscometer at 60 rpm and 20° C., between 100 and 180 mPas and/or a high-shear viscosity, measured in a Haake viscometer at 37,750 $s^{-1}$ and 20° C., between 7 and 20 mPas.

3. Method according to claim 1, wherein the first and/or second aqueous film-forming composition has a static surface tension, measured by a ring tensiometer, between 32 and 37 dyn/cm.

4. Method according to claim 1, wherein said first and/or second aqueous film-forming composition comprises a first emulsion polymer in a quantity between 10% and 70% by dry weight of said first polymer in relation to the total dry weight of resin and a second colloidal dispersion polymer in a quantity between 30% and 90% by dry weight of said second polymer in relation to the total dry weight of resin.

5. Method according to claim 1, wherein said first and/or second aqueous film-forming composition further comprises an additive selected from thickeners, surfactants, waxes, pigments, anti-foam agents, dispersants, levelling agents and their mixtures.

6. Method according to claim 5, wherein said first and/or second aqueous film-forming composition comprises a thickener in a quantity between 2% and 5% by dry weight of thickener, in relation to the total dry weight of resin.

7. Method according to claim 5, wherein said thickener is selected from the group formed by an acrylic thickener, a polyurethane thickener, an acrylic-acrylamide thickener, a cellulosic thickener and their mixtures.

8. Method according to claim 5, wherein said first and/or second aqueous film-forming composition comprises a surfactant in a quantity between 0.5% and 3% by dry weight of surfactant in relation to the total dry weight of resin.

9. Method according to claim 5, wherein said surfactant is selected from the group formed by an anionic surfactant, a non-ionic surfactant and their mixtures.

* * * * *

UNITED STATES PATENT AND TRADEMARK OFFICE

CERTIFICATE OF CORRECTION

PATENT NO. : 7,740,914 B2
APPLICATION NO. : 10/585043
DATED : June 22, 2010
INVENTOR(S) : Luis Amando Ortega Mahave et al.

It is certified that error appears in the above-identified patent and that said Letters Patent is hereby corrected as shown below:

Title page, Assignee should read as follows: --(73) Assignee: Sarriopapel Y Celulosa, S.A., Leiza (Navarra) (ES)--

Signed and Sealed this

Thirty-first Day of August, 2010

David J. Kappos

David J. Kappos
*Director of the United States Patent and Trademark Office*